US007992935B2

(12) United States Patent
Opsvik

(10) Patent No.: US 7,992,935 B2
(45) Date of Patent: Aug. 9, 2011

(54) BACK SUPPORTING DEVICE

(75) Inventor: Peter Opsvik, Oslo (NO)

(73) Assignee: Peter Opsvik AS (NO)

( * ) Notice: Subject to any disclaimer, the term of this patent is extended or adjusted under 35 U.S.C. 154(b) by 125 days.

(21) Appl. No.: 12/280,547

(22) PCT Filed: Feb. 23, 2007

(86) PCT No.: PCT/NO2007/000070

§ 371 (c)(1),
(2), (4) Date: Aug. 22, 2008

(87) PCT Pub. No.: WO2007/097636

PCT Pub. Date: Aug. 30, 2007

(65) Prior Publication Data

US 2009/0224582 A1 Sep. 10, 2009

(30) Foreign Application Priority Data

Feb. 24, 2006 (NO) ..... 20060918

(51) Int. Cl.
*A47C 7/40* (2006.01)
*A47C 7/42* (2006.01)

(52) U.S. Cl. ..... 297/230.1; 297/230.11; 297/230.12; 297/230.13; 297/230.14; 297/219.12

(58) Field of Classification Search ..... 297/230.1, 297/230.11, 230.12, 230.13, 230.14, 219.12
See application file for complete search history.

(56) References Cited

U.S. PATENT DOCUMENTS

| | | | | | |
|---|---|---|---|---|---|
| 132,762 | A | * | 11/1872 | Haupt | 297/230.12 |
| 375,471 | A | * | 12/1887 | Binder | 297/230.12 |
| 769,495 | A | * | 9/1904 | Schroeder | 297/230.1 |
| 2,008,392 | A | * | 7/1935 | Heller | 297/301.4 |
| D362,554 | S | * | 9/1995 | Grundner | D6/339 |
| D365,449 | S | * | 12/1995 | Wood | D6/333 |
| 5,860,696 | A | * | 1/1999 | Opsvik et al. | 297/230.1 |
| D590,608 | S | * | 4/2009 | Ebina | D6/339 |
| D599,143 | S | * | 9/2009 | Opsvik | D6/502 |
| D614,893 | S | * | 5/2010 | Opsvik | D6/500 |

FOREIGN PATENT DOCUMENTS

| | | |
|---|---|---|
| DE | 9312828 U1 | 11/1993 |
| WO | 95/30360 | 11/1995 |

* cited by examiner

*Primary Examiner* — Rodney B White

(74) *Attorney, Agent, or Firm* — Kolisch Hartwell, P.C.

(57) ABSTRACT

The present invention concerns a back support device (60) for use in a children's chair (1) wherein the children's chair comprises at least one backrest, two side pieces (5), one seat plate (2) and one safety bow (100) with ends (101), wherein the safety bow (100) is detachably fastened to the side pieces (5) and wherein the backrest or the side pieces have at least one opening or groove each, wherein the back support device (60) comprises: a top part (61) stretching beyond the backrest in height; left and right arms (63) for at least partly inlay in the opening(s) or groove(s) in the backrest or the side pieces; wherein parts of the arms (63) are locked in said opening(s) or groove(s) by the safety bow (100). The invention also concerns the use of the back support device, and a children's set comprising the back support device and use of the children's set.

26 Claims, 6 Drawing Sheets

BACK SUPPORTING DEVICE

The present invention concerns a back support device for a backrest, especially in order to heighten and adapt a backrest in a children's chair. The back support device is suitable for a children's chair with existing low backrest and side pieces, possibly with the opportunity for vertical and horizontal adjustment of the seat plate and foot plate. Further, the invention concerns a back support and safety bow set for a children's chair and the use of a backrest support device and the set in a children's chair.

BACKGROUND OF THE INVENTION

It is well known that small children, that is children such as in the age when they may sit by themselves (about 6-7 month) until they master sitting safely in a children's chair (about 2 years), need additional support for sitting properly in the chair. The support helps the child in relieving muscles and the skeleton and hinders the child in bending far out of the chair, possibly safety equipment hindering the child from falling out of children's chairs is used in addition.

In order to obtain maximum support for the child it is known to shape mould the seat of a children's chair and to integrate a cross bow and crotch bar. The disadvantage with shape moulded chair seats is that the seat may not be varied in relation to the size and age of the child. Often, such a seat is combined with a harness in order to secure the child from climbing out of the chair. However, the harness does not provide the extra physical support which may be necessary.

In later years, a development has evolved in the direction of more countries and regions having their own safety measures for equipment to be used by children, such as in children's chairs. This must be taken into account in the development of new children's chairs, but it may be difficult to adapt chairs which have been produced for a long period before such safety provisions were put into force. It is especially difficult to perform such adaptations on chairs that have already been sold for many years, without making physical interventions on the chairs. There are thousands of such chairs around in homes. Further, it is a disadvantage continuously having to change the production of such chairs as changes are made in regulations and to put up production lines adapted to each country and their special regulations. It would therefore also be an environmental advantage to be able to adapt a standard children's chair with adaptive equipment making it simple and reasonable to update the chair without having to throw away the entire chair when changes in regulations happen.

This is for example the case with the children's chair Tripp Trapp® which was developed as early as in 1972 and patented in 1976 and which still is a very popular children's chair in many countries.

The Tripp Trapp® chair is designed to be adjusted in coherence with the body size of the child and therefore has a seat plate and a foot plate which may be moved to different height positions in that they glide in tracks in the side pieces and are locked by tightening the distance between the side pieces. The sitting plate may further be adjusted in the depth position in that a plate is pushed in relation to the backrest which is permanent. The backrest consists of two parallel crosspieces with about constant height and distance in relation to each other. Both crosspieces are arched towards the back in the middle portion to adapt to the users back.

For the Tripp Trapp® chair a children's safety bow was also developed for use with the smallest children as described in Norwegian patent NO 132.782 (Petter Opsvik). The safety bow fits in thereto adapted tracks on the inside of the side pieces, in the same height as the back support device, and is arched forward to define an opening for the child together with the back support device. In installing the safety bow, the safety bow is compressed to slip each of the ends into the tracks in the side pieces and the safety bow thereby locks itself in the correct position by its own tension, without the use of tools of any kind. Possibly, a crotch strap may be used which is threaded onto the safety bow and which is fastened via a hole in the seat plate.

It has also proven difficult to adapt existing chairs and children's equipment to new effective demands, if the above mentioned original functions of the chair are to be maintained at the same time. This is for example the case of the demand for a tall and adapted back on children's chairs to prevent the child in throwing itself backward and hurt the dorsal vertebra or falling out.

From DE 9612828 a combined back support and seat plate padding device is known for use in a children's chair similar to the chair mentioned above. The device has back support with a top part extending above the back rest with a rear sleeve for threading onto the back rest, alternatively a flap for wrapping around the rear side of the back rest and reattaching to the padding device by a zipper. The device being one continuous piece is limited in the adjustment of the seat height as a low position will strain the transition between the seat plate portion and the back support portion. Further, the mounting of the device without zipper would necessitate demounting of the chair, with the help of tools. However, by using a zipper, the device might easily be tampered by a child, thus jeopardizing the functioning of the device.

It is therefore an objective to provide equipment as mentioned above so that the owners of older chairs and new chair may upgrade their chairs according to changes in regulations and standards. Further, that the chair does not need to be equipped as a children's chair for the smallest children when this is not the users situation, namely when the chair is used by a child over the age of 3 or by an adult. It is also an objective to avoid physical adaptations, such as making holes in any of the parts or inserting screws that leave spoiling marks in the chair which will be visible when there no longer is use for the back support device or the safety bow. Such interventions may further result in the risk that the user makes adaptations in the wrong manner, so that the safety is not kept intact. It is therefore an objective with the invention to make the fastening of the additional equipment as intuitive and simple as possible, without the use of tools, and upholding safety at the same time.

DESCRIPTION OF THE INVENTION

In order to attain these objectives the applicant has developed a back support device which solves the above mentioned problems.

The present invention thus concerns a back support device for use in a children's chair wherein the children's chair comprises at least one backrest, two side pieces, one seat plate and one safety bow with ends, the safety bow being detachably fastened to the side pieces and the backrest or the side pieces having at least one opening or groove each, the back support device having a top part extending beyond the backrest in the height direction and wherein the back support device further comprises: left and right arms for at least partly inlay into the opening(s) or groove(s) in the backrest or the side pieces; wherein parts of the arms are locked in said opening(s) or groove(s) by the safety bow.

The invention further concerns the use of the back support device above in a children's chair, a children's set for a children's chair comprising such a back support device and a safety bow, and the use of the children's set in a children's chair.

The invention will now be described in further detail by the help of examples of embodiments and the attached drawings, none of which are meant to limit the scope of the invention which is defined only by the appended claims.

SHORT DESCRIPTION OF THE DRAWINGS

DETAILED DESCRIPTION

Figure 1:
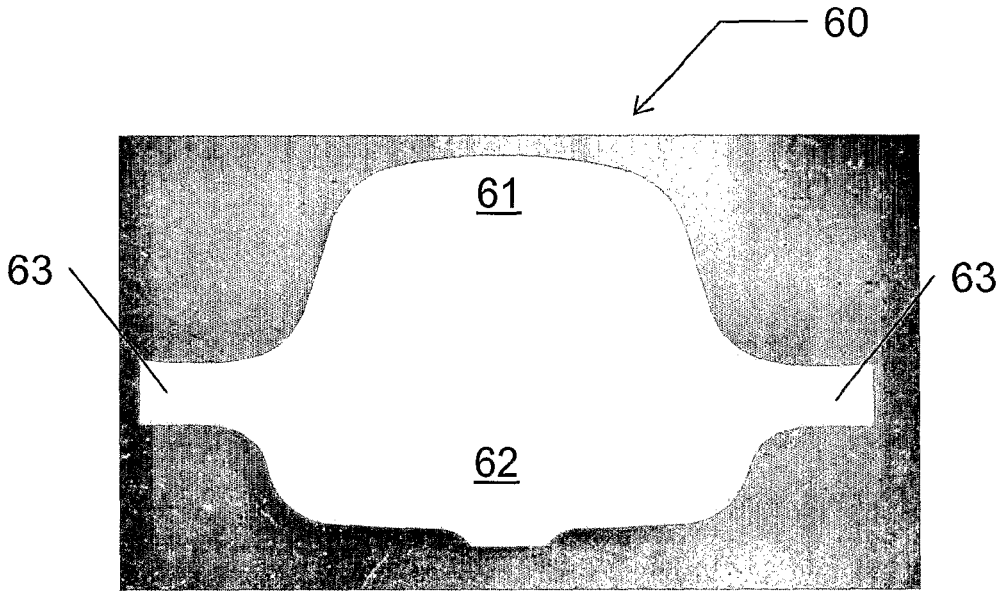
FIG. 1 shows a frontal planar view of a back rest device according to the present invention.

As may be seen from FIG. 1, the back rest support device 60 according to the invention consists of a piece of plate comprising a top part 61, and a bottom part 62, and right and left arm 63. 63 May also be a part of 60 to mounted. The piece of plate may preferably be slightly concavely arched in the horizontal plate, especially the centre portion, in order to adapt to the back of the user and possibly also the existing backrest in the chair where the back support device is to be installed.

Figure 2:
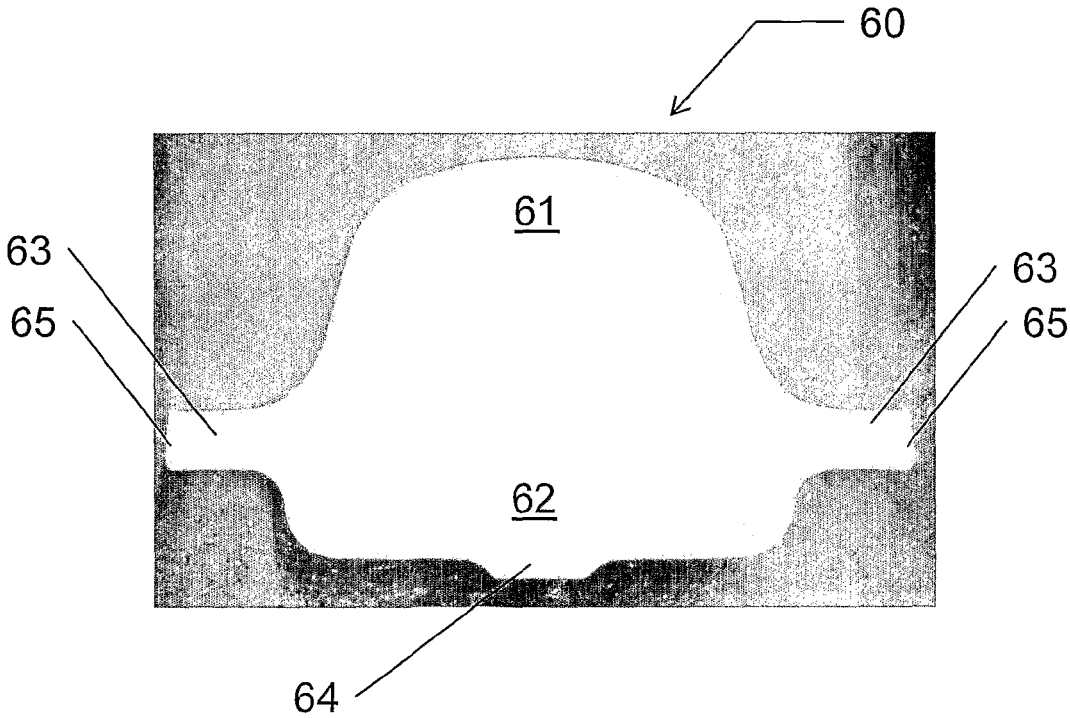
FIG. 2 shows the back support device in FIG. 1 seen from behind.

FIG. 2 shows the back support device 60 seen from behind. As may be sent the bottom part 62 comprises a central extension on the lower end edge which is bent back and upwards in the form of a wide hook 64. Likewise, both arms 63 comprise extensions drawing backward as claws 65

Figure 3:
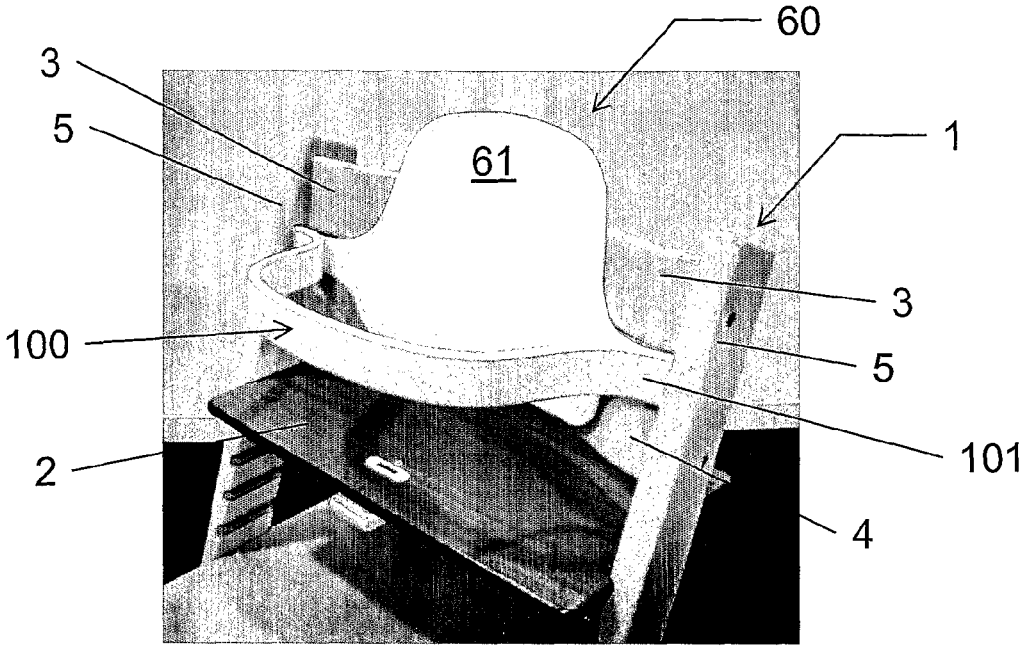
FIG. 3 shows the back support device in FIG. 1 used in a children's chair.

The latter feature has a fastening function which is apparent from FIG. 3. In this figure the back support device 60 is installed in a Tripp Trapp® chair 1 without the use of extra fastening means. The back support device 60 is positioned with the convex backside towards the existing concave backrest in the chair, which consists of the parallel arranged upper and lower cross pieces 3 and 4 respectively. The arms 63 of the back support device 60 are partly directed in the gap between the upper and lower cross piece 3 and 4 and the original safety bow 100 is strained firmly over the ends of the arms 63 in the original tracks in the side pieces 5 of the chair. The ends of the arms 63 are squeezed and thereby locked into the gap between the crosspieces, without the need for tools.

Figure 4:
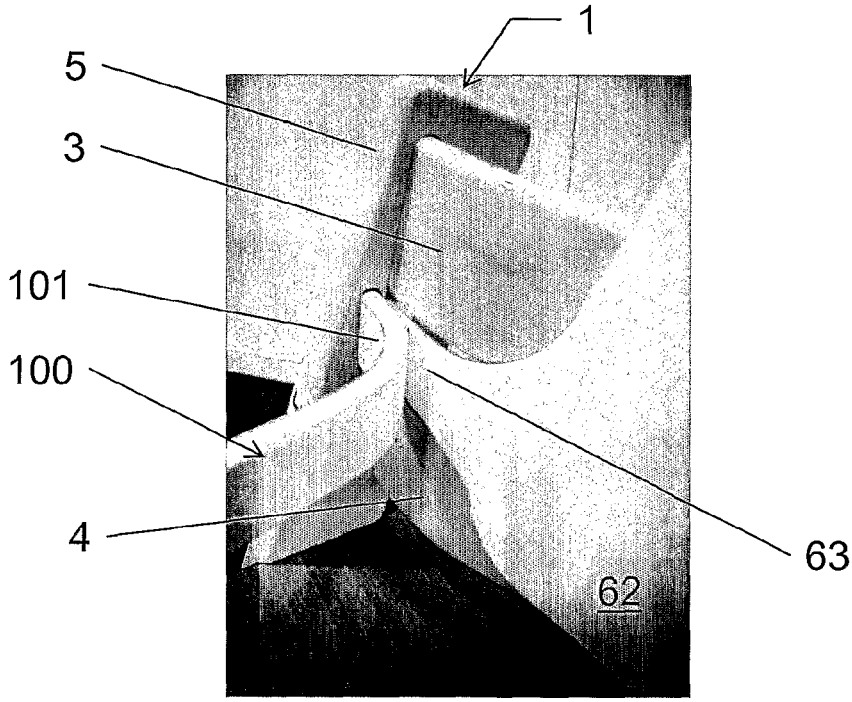
FIG. 4 shows en a detailed view of FIG. 3.

The squeezing of the arms 63 in the gap between the upper and lower crosspiece 3 and 4 is shown in closer detail in FIG. 4. In this embodiment the width of the arms are somewhat lager than the mentioned gap and especially the claws 65 (as shown in FIG. 2) in the end of the arms 63, which stay between the upper and lower crosspiece 3 and 4 as apparent from FIG. 5.

Figure 5:
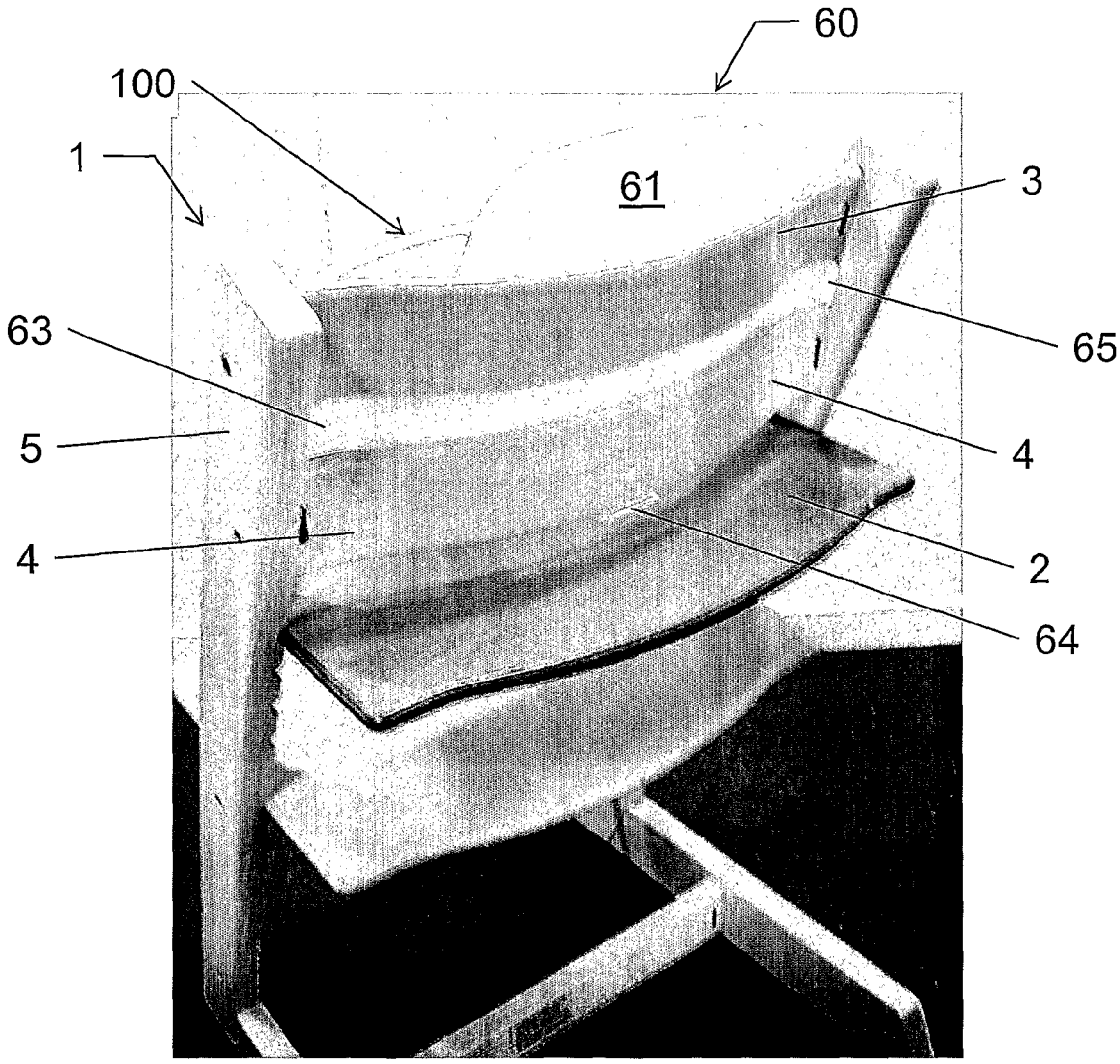
FIG. 5 shows the back support device in FIG. 3 seen partly from behind.

FIG. 5 further shows the height of the back support device 60 provided at the top end 61 in relation to the original backrest 3, 4. As may also be seen from the figure the backward bent hook 64 on the bottom part 62 grasps around the lower edge of the lower crosspiece 4. The objective with the hook 64 is especially to hinder torsion of the back support device if the child in the chair leans hard or throws itself against the top part 61 so that the bottom part 62 moves out of the lower crosspiece 4. The hook 64 also complement the resistance of the claws 65 against the back support device 60 being able to move upward, e.g. if the chair is lifted in the back support device 60.

Alternative Embodiments

Figure 6:
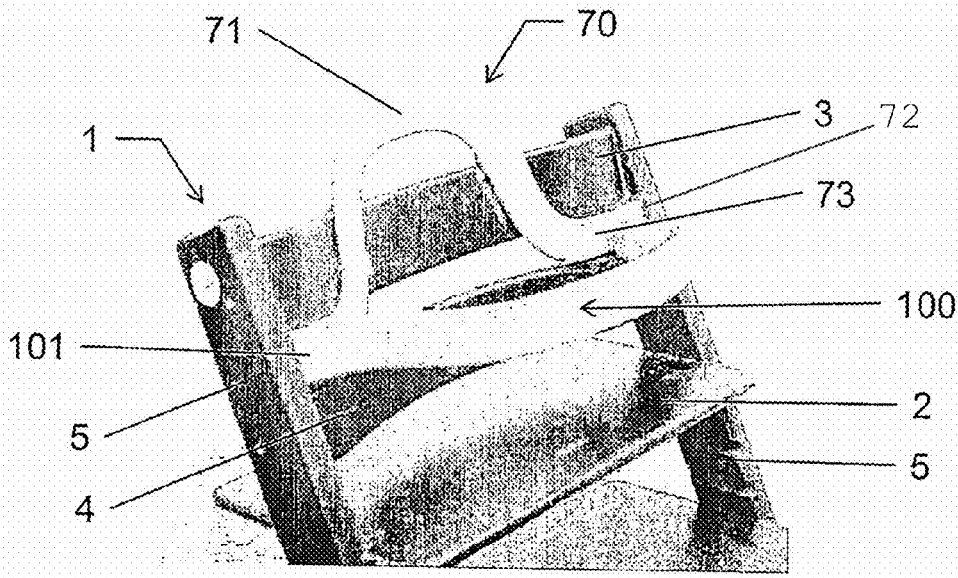
FIG. 6 shows another embodiment in frontal perspective of a back support device according to the invention.
Figure 7:
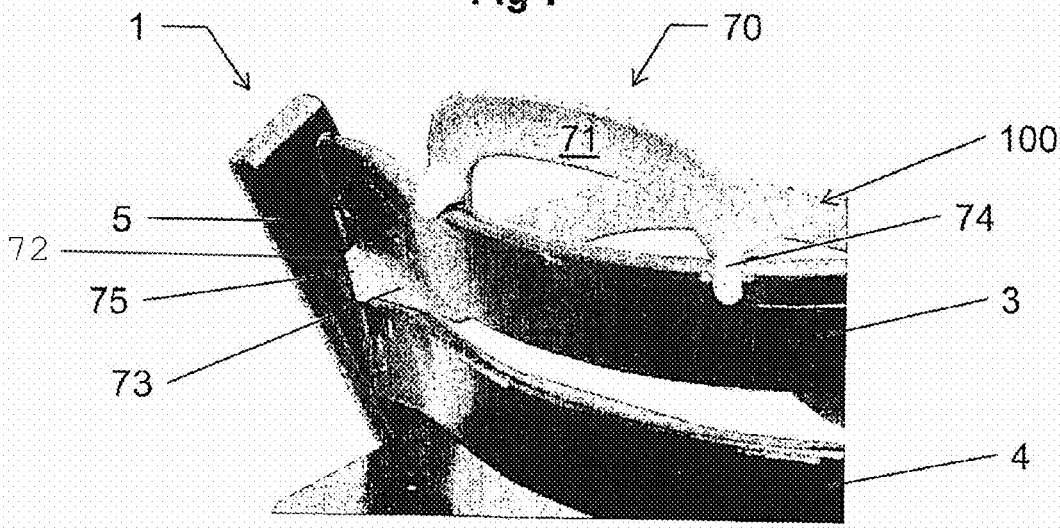
FIG. 7 shows the back support device in FIG. 6 seen from behind.

In FIG. 6 an alternative embodiment of the back support device is shown with an open shape, as a bow. As shown in the figure the arms 73 of the back support device 70 are locked against the crosspieces 3 and 4 by the help of the safety bow 100 in the same manner as shown earlier. In addition, the ends of arms 73 of back support device 70 are inserted into openings 72 set into side pieces 5. However, it should be noted that this shape of the backrest 70 demands higher stiffness and strength of the material in which the back support device is made of, than that of the preceding embodiment. In this example the back support device 70 is for example made of wood, hard plastic or metal, and has a shape which mirrors that of the safety bow 100. As the back support device 70 only has a top part 71 and no bottom part, it will alternatively be necessary with further fixing points to the crosspieces 3 and 4 as shown in FIG. 7. As may be seen from the figure the arms 73 also comprise claws 75 which are locked in the gap between the upper and lower crosspiece 3 and 4. In order to reduce the load on the arms 73 and especially the claws 75, the back support device in this embodiment comprise hooks 74 grasping around the top edge of the upper crosspiece 3. The hooks 74 hinder the child or a grown up in taking hold of the top part 71 and bending the back support device forward with the dangers this may cause. The open embodiment provides good aeration in the back of the child and provides the necessary support for the upper back, neck, and head area.

The hooks 64 and 74 are one example of fastening means which may be used to lock the back support device to the crosspiece(s) or the backrest. Alternatively other fastening means may be used as known by the person skilled in the art.

The torsion rigidity of the back support device is of course dependent on what material it is made of, as well as the shape, as shown in the embodiments above. The back support device may as a starting point be made in any material such as wood, metal, plastic, reinforced plastic, foamed plastic or a composite material, and preferably plastic. The material should own torsion rigidity and a strength which secure that the fixing points, that is, the arms 63, 73, the hooks 64, 74 and the claws 65, 75 do not break under normal load. Alternatively, several different materials may be used in the back support device, such as a laminated assembly where the front side of the back support device has a padded quality, while the rear material, or a core, has a stiffening effect. Possibly, the safety bow 100, may be made of the same material and contain the same quality, such as a padding for example.

For comfort and safety reasons it may be an advantage that the back support device contains a certain flexibility. The flexibility may lead to the child not hurting its back, neck, and head if it leans backward. The back support device may also preferably absorb the force if the child should throw itself backward in a sudden movement and thereby also hinder that the chair tips backwards, for example by padding as mentioned above. Under such cases it is however also a danger that parts of the rear side of the back support device will lift itself somewhat away from the crosspieces 3 and 4 as the back support device may be strained in an arch. A danger thereby arises for the child to get a finger in between the back support device and the cross pieces 3 or 4 and pinch itself when the pressure on the back support device subsides.

Figure 8:
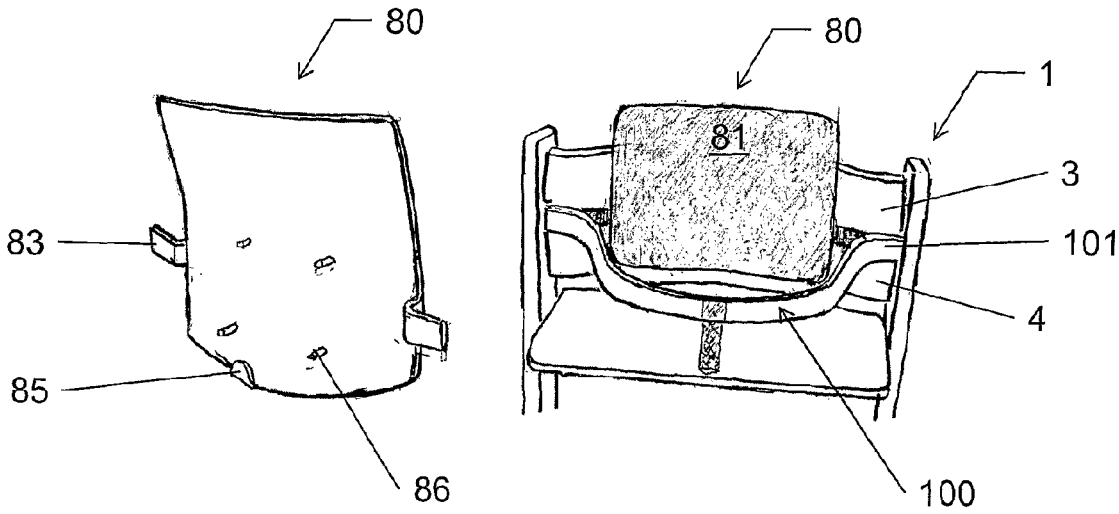
FIG. 8 shows a third embodiment of a back support device in rear perspective used in a children's chair.

In order to avoid pinching of fingers or the likes, one or more spacers are arranges on the backside of the back support device as shown in FIG. 8 in a third alternative embodiment. The spacers 86 are preferably placed on the inner part of the backside of the back support device 80. The spacers abut the crosspieces 3 and 4 when the back support device is mounted to the chair 1 and holds the back support device 80 in a constant distance from the original backrest 3, 4. The spacers 86 are positioned in a distance from the side edges so that the child may not come into contact with them. As the back support device 80 thereby is displaced forward in the chair, the arms 83 are adapted correspondingly and therefore comprise backward directed extensions so that the ends may be placed in squeeze between the ends 101 of the safety bow 100 and the gap of the crosspieces 3, 4. The arms are moulded or fastened on the back side of the rear side of the back support device. An additional advantage in displacing the back support device 80 forward in the chair 1 is that the centre of gravity of the child is moved forward and thereby reducing the risk of the chair tipping backward if the child throws itself backward in the chair. Further, the opening between the safety bow 100 and the back support device 80 is reduced so that small children obtain even tighter support when they are sitting. Alternatively, the back support device may be depth adjustable, for example by the spacers 86 and the hook 85 being changeable and available in different thicknesses, or that they are adjustable, in order to adapt the seat in the best manner for the user.

Figure 9:
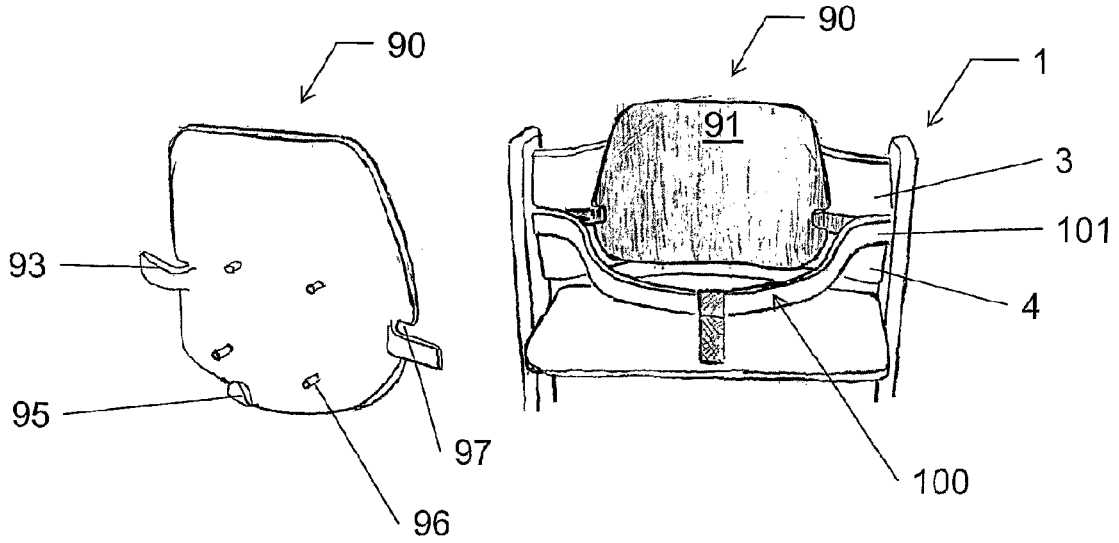
FIG. 9 shows en forth embodiment of a back support device in rear perspective view used in a children's chair from the front.

In FIG. 9 a fourth embodiment is shown, wherein the fixing points for the arms 93 of the back support device 90 are displaced with indent in the back support device in relation to the side edges. The arms 93 are moulded or fastened to the backside of the back support device 90. The arms 93 have similarly to the former embodiment backward directed extensions corresponding to the thickness of the spacers 96. The displacement of the fixing points for the arms 93 thereby make it possible or easier to thread a cover around the back support device 90, such as a textile cover and/or a padded cover which protects the back support device and/or increases the comfort for the user, or also gives the back support device another look.

Figure 10:
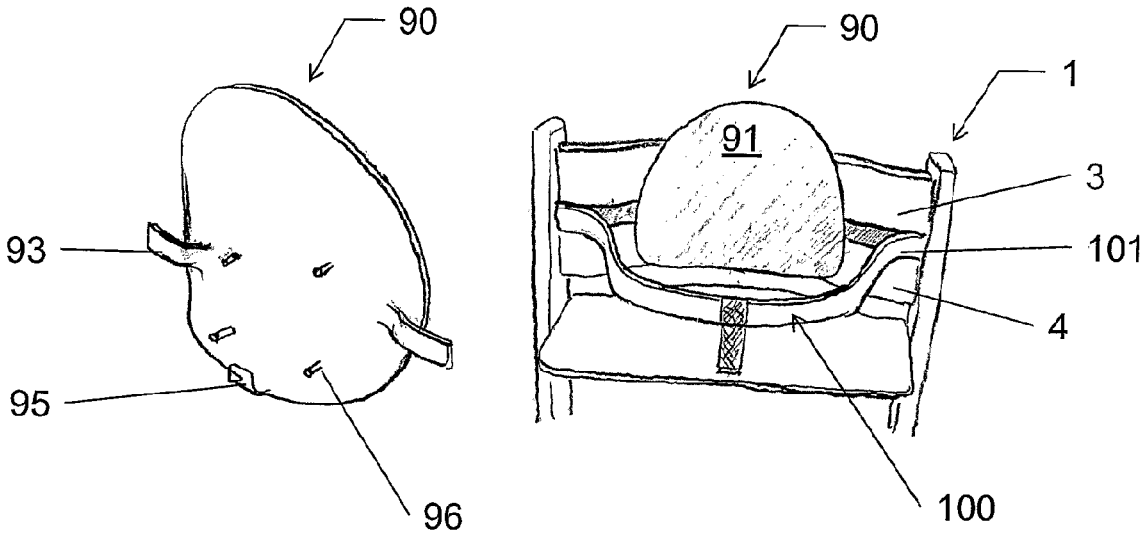
FIG. 10 shows a fifth embodiment of a back support device in rear perspective and used in a children's chair from the front.

In FIG. 10 a fifth embodiment is shown, corresponding to that of FIG. 9, but there is no indent in the arms 93. The advantage with this embodiment is that it provides a better aesthetical impression of the back support device 90 and that there are no indents on which the child may hurt itself.

The spacers 86, 96 may have any form and any number according to what is practical, preferable and/or aesthetical. In the embodiments over four spacers are shown, two for each crosspiece 3, 4. Alternatively the spacers may be formed as long ledges, such as between two and two of the shown spacers, either in the vertical or horizontal direction. Alternatively a large spacer covering a corresponding, smaller or larger area on the backside of the back support device may be used. The essence is that the spacer(s) is(are) not positioned too close to the side edges of the back support device so that the child may get a finger between the spacer(s) and the backrest 3, 4 and pinch itself if the back support device is lifted somewhat from the backrest.

As shown in the figures of the above embodiments, especially the top part of the back support device may be varied in different shapes sand looks, such as tall, low, narrow or wide shaped, as well as rounded, oval, round or square shaped. Most important is that the height and shape provides sufficient support for the child's back, neck and possibly head and that the shape is not suitable for the child hurting itself or moving outside of the support area defined by the shape. Any form and height of the back support device may be shaped to satisfy the safety regulations of different countries and regions. The shape may also be altered with changes in such regulations and makes it easy to renew only the back support device, without having to change the entire chair or parts of the chair. This solution is of course also preferable in terms of production, transport and environment.

In the embodiments the chair 1 has an original backrest, consisting of two horizontal parallel cross pieces 3 and 4 constituting a continuous opening with a defined height. However, the opening may just as well consist of two separate openings in the backrest or the side pieces of the chair, such as two parallel grooves for example, with a defined height and possibly a defined width. The openings need neither be continuous, but may be grooves such as tracks which makes locking possible by squeezing of the arms of the back support device with the safety bow and which hinder movement by friction.

The advantage with the back support device according to the invention is thereby that it may be used on an existing chair, such as a Tripp Trapp® chair or other chairs, without making physical changes on any parts of the chair, or demand the use of fixing means, such as screws. The back support device is simply hooked onto the backrest by the help of the existing components only and is squeezed tight in the side edges with the existing safety bow. The back support device does not hinder adjustment of the chair, such as height adjustment and/or depth adjustment of the seat plate, and the original functions of the chair are thereby attended to. The back support device may easily be removed, possibly together with the safety bow, or be replaced, or moved to another corresponding chair when it is no longer needed in the first chair.

Another advantage with the back support device according to the invention is that all necessary fastening organs for fastening in a children's chair may be integrated in the back support device, as shown in the figures, without the need for extra loose parts or the use of tools. The invention thus also concerns the use of the back support device in a s children's chair, and especially in a Tripp Trapp® chair.

As the back support device according to the invention is locked by the help of the safety bow 100, it may be advantageous to gather these parts in a set for the consumer. The present invention therefore also concerns a children's set for a children's chair comprising a safety bow and a back support device according to the invention, alternatively together with a children's harness and/or a seat cover and backrest cover, as well as the use of such a set in a children's chair, especially in a Tripp Trapp® chair.

The above mentioned alternatives and features may of course be used in combination with each other.

The invention claimed is:

1. A back support device and safety bow set for a children's chair, where the children's chair includes a backrest, two side pieces, and a seat plate, the backrest having at least one opening or groove and the side pieces having at least one edge and having at least one opening or groove each, the set comprising:

a safety bow having two ends, each of the two ends being detachably fastenable to a corresponding one of the two side pieces; and a back support device comprising:

left and right arms that can be at least partly inserted into the opening(s) or groove(s) of the backrest or the opening(s) or groove(s) of the side pieces; wherein portions of the arms of the back support device can be locked in the opening(s) or groove(s) by the safety bow.

2. The back support device and safety bow set according to claim 1, wherein the backrest comprises one or more crosspieces having upper or lower edges.

3. The back support device and safety bow set according to claim 2, wherein the back support device includes one or more fasteners configured to attach the back support to one or more of the crosspiece(s) or side pieces.

4. The back support device and safety bow set according to claim 3, wherein the fasteners include one or more hook(s) adapted to grasp one or more of the lower or upper edges of the crosspiece(s) or edges of the side pieces.

5. The back support device and safety bow set according to claim 4, wherein the one or more hook(s) are backwardly directed hook(s).

6. The back support device and safety bow set according to claim 2, wherein the backrest comprises two parallel crosspieces.

7. The back support device and safety bow set according to claim 6, wherein the two parallel crosspieces include an upper crosspiece and a lower crosspiece with a vertical distance therebetween defining the at least one opening as a horizontal opening.

8. The back support device and safety bow set according to claim 1, wherein the side pieces have at least one groove and the safety bow is detachably fastenable to the side pieces by straining the safety bow ends into the grooves in the side pieces.

9. The back support device and safety bow set according to claim 8, wherein the safety bow is detachably fastenable to the side pieces without the use of tools.

10. The back support device and safety bow set according to claim 1, wherein the safety bow ends are configured to lock the arms in said opening(s) or groove(s) by at least partly covering the arms when the safety bow ends are fastened to the side pieces.

11. The back support device and safety bow set according to claim 1, wherein the arms of the back support device further comprise backward directed claws adapted for inserting into the opening(s) or groove(s) in the crosspiece(s) or side pieces.

12. The back support device and safety bow set according to claim 1, wherein the back support device includes one or more spacer(s) on the rear side of the back support device abutting the crosspiece(s).

13. The back support device and safety bow set according to claim 12, wherein the spacer(s) are replaceable or may be adjusted in thickness.

14. The back support device and safety bow set according to claim 1, wherein the back support device is depth adjustable.

15. The back support device and safety bow set according to claim 1, wherein the arms are molded or fixed on the rear side of the back support device with a distance from side edges of the back support device.

16. The back support device and safety bow set according to claim 1, wherein the back support device is made of wood, metal, plastic, reinforced plastic, foamed plastic or a composite material.

17. The back support device and safety bow set according to claim 1, wherein the back support device has a padded quality.

18. The back support device and safety bow set according to claim 1, wherein the height of the back support device may be adjusted relative to the user by height adjustment of the seat plate.

19. The back support device and safety bow set according to claim 1, wherein the front side of the back support device has a padded quality.

20. The back support device and safety bow set according to claim 1, wherein the back support device has a flexibility that springs against and/or absorbs the movements of the user.

21. The back support device and safety bow set according to claim 1 in a children's chair.

22. The use of a back support device and safety bow set according to claim 1 in combination with a children's chair.

23. The back support device and safety bow set according to claim 1, wherein the back support device has a convex backside towards a concave backrest of the chair.

24. The back support device and safety bow set according to claim 1, wherein the back support device is made in one piece.

25. The back support device and safety bow set according to claim 1, wherein the back support device includes a top part that extends beyond the backrest of the chair in a height direction.

26. A children's chair, comprising:

a backrest comprising two parallel crosspieces including an upper crosspiece and a lower crosspiece with a vertical distance therebetween defining the at least one opening as a horizontal opening;

two side pieces having at least one track each;

a seat plate;

a safety bow having two ends and being detachably fastenable to the side pieces by straining the safety bow ends into the tracks in the side pieces; and a back support device comprising:

a top part that extends beyond the backrest of the chair in the height direction; and left and right arms that can be at least partly inserted into the opening(s) of the backrest;

wherein portions of the arms of the back support device are locked in the opening(s) by the safety bow.

* * * * *